US005613734A

United States Patent [19]

Michael et al.

[11] Patent Number: 5,613,734

[45] Date of Patent: Mar. 25, 1997

[54] CHAIR WITH VERTICALLY ADJUSTABLE BACK

[75] Inventors: Robert S. Michael; Joe E. Miller; David P. Zagaroli, all of Hickory, N.C.

[73] Assignee: Bassett Furniture Ind. Inc., Bassett, Va.

[21] Appl. No.: 598,552

[22] Filed: Feb. 8, 1996

[51] Int. Cl.[6] ..... B60N 2/22

[52] U.S. Cl. ..... 297/353; 297/410

[58] Field of Search ..... 297/353, 410

[56] References Cited

U.S. PATENT DOCUMENTS

| | | | |
|---|---|---|---|
| 2,427,234 | 9/1947 | Shepard | 297/353 |
| 2,578,114 | 12/1951 | Webber | 297/353 |
| 2,599,301 | 6/1952 | Van Buren | 297/353 |
| 4,139,235 | 2/1979 | Elbert | 297/284 X |
| 4,170,382 | 10/1979 | Wheeler | 297/353 X |
| 4,456,298 | 6/1984 | Gottstein | 297/353 |
| 5,035,466 | 7/1991 | Mathews et al. | 297/353 X |
| 5,100,200 | 3/1992 | Keusch et al. | 297/296 |
| 5,335,971 | 8/1994 | Kelley | 297/378.12 |

*Primary Examiner*—Peter M. Cuomo
*Assistant Examiner*—Stephen Vu
*Attorney, Agent, or Firm*—Rhodes, Coats & Bennett, LLP

[57] ABSTRACT

The present invention entails a chair having a back movable between an upper operative position and a lower or retracted stowed position. The chair includes a base frame having a seat and a catch rail disposed below the seat. A retainer is spaced above the catch rail and there is defined a throughway between the catch rail and the retainer. A back is provided and is movable relative to the base frame. In the upper operative position the back engages and is supported by the catch rail while the retainer prevents the back from rotating past a predetermined position. In the lower retracted position, the back is disengaged from the catch rail and extends below the catch rail.

11 Claims, 4 Drawing Sheets

CHAIR WITH VERTICALLY ADJUSTABLE BACK

FIELD OF INVENTION

The present invention relates to chairs and more particularly to chairs of the type having a vertically adjustable back structure that can be moved from an upper operative position to a lower retracted or stowed position.

BACKGROUND OF THE INVENTION

In the past, it has been known to provide a chair having a back that is movable between an upright operative position and a stowed position. For example, in U.S. Pat. No. 5,335,971 there is disclosed a chair that has a back that extends upwardly from a base frame. The upper portion of the back is pivotally mounted about a transverse axis such that the back can be oriented in a generally vertical position for supporting the back of a person occupying the chair and a rotated generally horizontal position where the upper portion of the back is turned down adjacent the seat of the chair. This forms a stowed position and allows the chair when not in use to be disposed underneath a table, desk or the like.

There is, of course, advantages in a desk-type chair that includes a design that enables at least the top portion of the back of the chair to be moved downwardly to a position where the entire chair can be pushed or stowed under a desk, table or the like.

SUMMARY OF THE INVENTION

The present invention presents a chair having a back movable between an upper operative position and a lower retracted or stowed position. The chair includes a base frame having a seat. A catch rail is disposed below the seat and below a back retainer. Between the retainer and the catch there is defined a throughway. A back is movable relative to the base frame through the defined throughway. In the upper operative position, a lower portion of the back rests on the catch while the retainer engages a portion of the back and assists in preventing the back from rotating past a predetermined position. In the lower retracted or stowed position, the back is disengaged from the catch and extends below the catch such that the top portion of the back is effectively lowered.

DETAILED DESCRIPTION OF THE INVENTION

Figure 1:
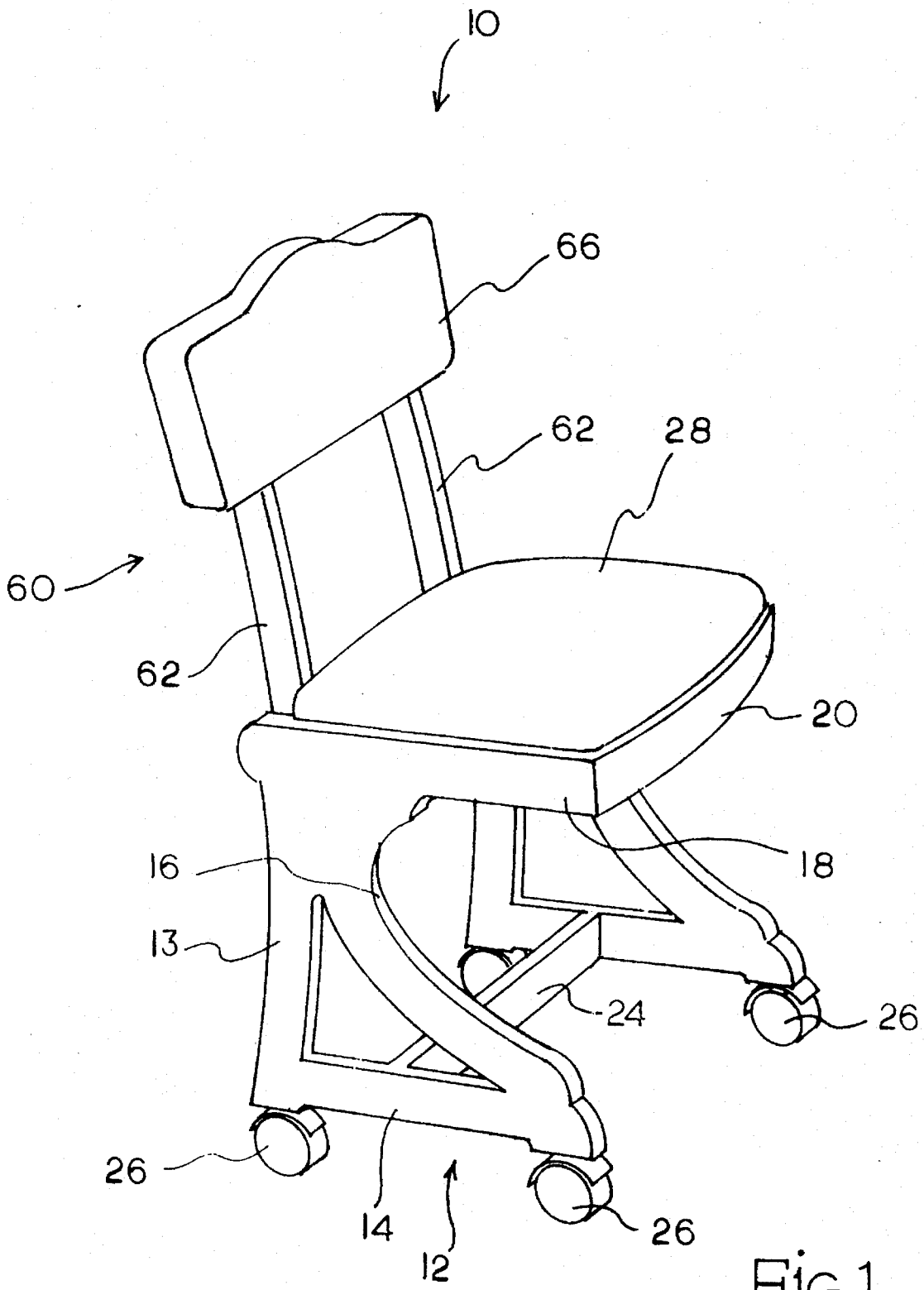
FIG. 1 is a perspective view of the chair of the present invention.

With further reference to the drawings, the chair of the present invention is shown therein and indicated generally by the numeral 10. Chair 10 includes a base frame indicated generally by the numeral 12. Base frame 12 comprises opposed side frames and certain interconnecting support structures. In particular, each side frame includes a vertical member 13, a base members 14, a diagonal or front brace 16, and a side rail 18. In addition, extending across the front of the chair between the side rails 18 is front cross member 20. Spaced behind the front cross member 20 is a back cross member 22. In addition, a lower cross member 24 extends between the base members 14 of the side frame. Disposed on the base frame 12 is a seat 28. Although not required, the base frame is supported by a series of wheels 26.

Disposed below the seat 28 is a catch 30 that is in the form of a rail. As seen in the drawings, catch 30 extends between the vertical members 13 of the side frame and is supported at a height generally intermediately between the top and bottom portions of the base frame 12. Catch 30 includes a top surface **30*a* and a rear side 30*b*. Note that in the embodiment illustrated herein, the top surface 30*a* angles upwardly from the front of the catch 30 toward the rear side 30*b***.

Spaced above catch 30 is a retainer 40 with a back side **40*a*. Retainer 40 is also in the form of a rail and extends transversely across the back of the base frame just rearwardly of the back cross member 22. A space is defined between the back cross member 22 and the retainer 40. That space, as will be discussed subsequently herein, enables the back of the chair to be inserted therethrough. Also, there is a throughway defined between catch 30 and retainer 40** and as will be appreciated, the back can move through this throughway.

Now, turning to the back of the chair 10, the back is shown in the drawings and indicated generally by the numeral 60. As will be appreciated, back 60 is movably mounted within the throughway defined between the catch 30 and the retainer 40.

In the case of the design illustrated herein, back 60 includes a pair of laterally spaced vertical support members 62. Each support member 62 includes a lower portion. Formed on the lower portion of each vertical support member 62 is a notch that is designed to engage the catch 30. In particular, each notch includes a side surface **62*a* and a top surface 62*b*. Note that side surface 62*a* is open towards the front while the top surface 62*b* angles downwardly toward the front of the respective support member 62. As appreciated from the drawings, the respective notches formed on the lower ends of the vertical support members 62 are designed to mate with the catch 30 and particularly designed to mate about the top surface 30*a* and rear side 30*b***.

In addition, formed about the lower portion of each vertical support member 62 is a stop **62*c*. This stop 62*c* is formed on the back of the support member 62 opposite the respective notches. As seen in the drawings, the respective stops 62*c* project rearwardly. The purpose of the stop 62*c* is to prevent the back structure from being pulled entirely out from the space defined between the back cross member 22 and retainer 40. That is, it is appreciated that if the back 60 is continued to be pulled upwardly, the stop 62*c* will engage the lower portion of the retainer 40 and prevent the support members 62 from being pulled from the base frame 12** of the chair.

The back 60 also includes a cross member 64 that extends between the lower portion of the support members 62. It is appreciated that various cross members and other reinforcing structure can be incorporated as needed in the base frame as well as the back.

Figure 3:
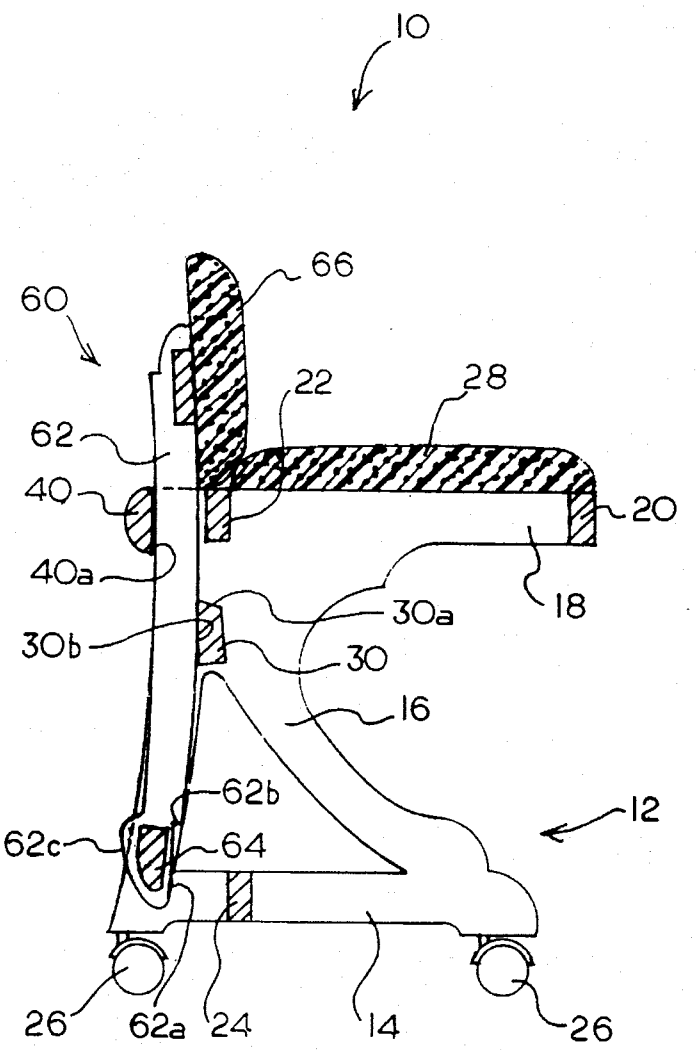
FIG. 3 is a side elevational view similar to FIG. 2 but with the back being disposed in the lower retracted or stowed position.

Back 60 also includes a back pad 66. The back pad 66 extends transversely and is effective in the present design to form a stop when the back 60 is moved downwardly to its retracted or stowed position. In particular, as seen in FIG. 3, when the back 60 assumes the downward retracted or stowed position, the pad 66 effectively contacts and stops against the side rails 18 that in the present design form a part of the respective side frames of the base frame 12.

In the upper operative position, it is seen that the support members 62 of the back 60 extend through the throughway defined generally between the catch 30, retainer 40 and back cross member 22. Note that the notches formed in the lower portion of the support members 62 engage the upper and back portion of the catch 30. In particular, the top surface **62*b* of the notch rests on the angled upper surface 30*a* of the catch. This basically supports the back 60 vertically and prevents the back from moving or falling downward. At the same time, the rear side surface 62*a* engages the back or rear side 30*b* of the catch. This prevents the lower portion of the support members 62** from rotating counterclockwise as viewed in the drawings.

The back 60 in the upper operative position is further stabilized by the cooperative efforts of the retainer 40. Note that retainer 40 engages a back portion of the vertical support members 62 and prevent the adjacent portion of the back structure from rotating counterclockwise as viewed in the drawings. Thus, catch 30 in cooperation with the retainer 40 stabilizes the entire back 60 especially when back pressure is applied to the back by a person occupying seat 28.

Figure 2:
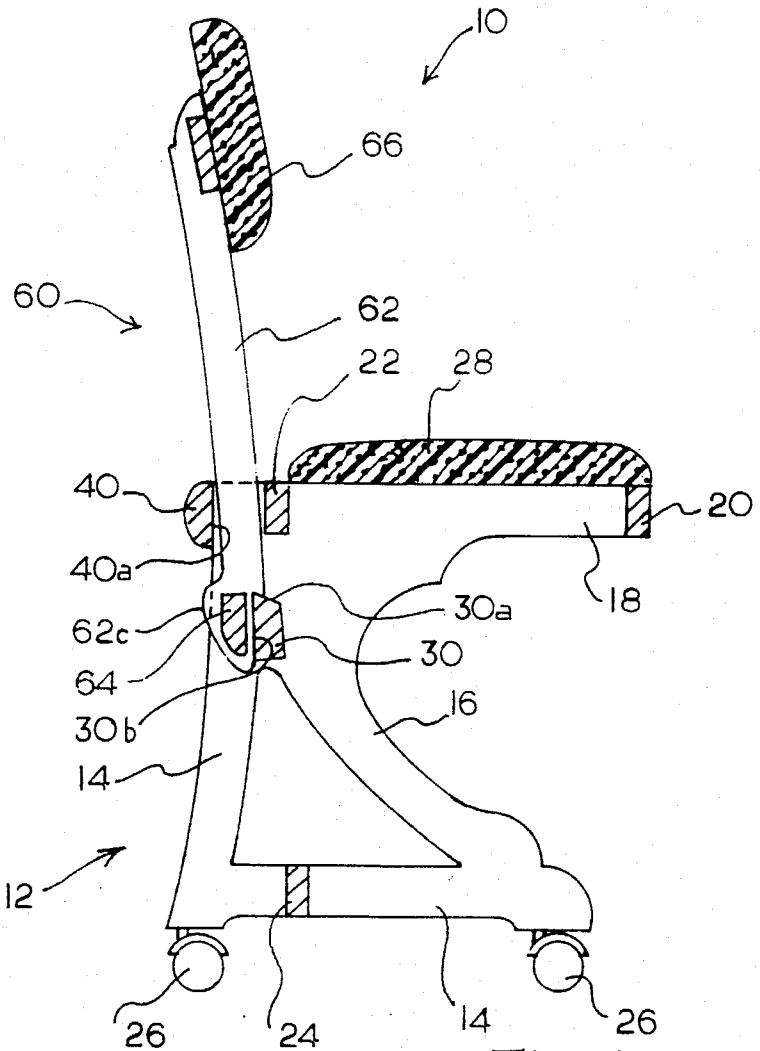
FIG. 2 is a side elevational view of the chair with the back being in the upper operative position and with a portion of the base frame removed to better illustrate the structure of the chair.
Figure 5:
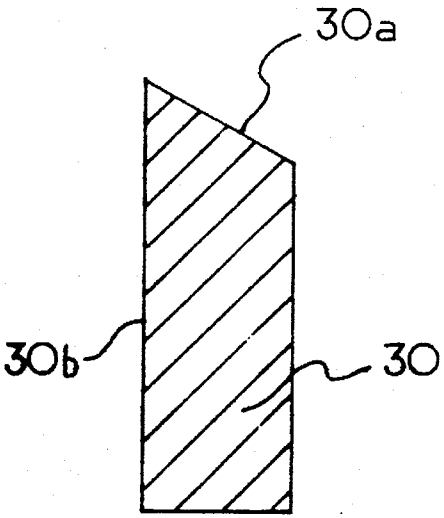
FIG. 5 is a side view of the catch that is utilized to support the back when the same is in the upper operative position.

Now, to move the back 60 from the upper operative position shown in FIG. 2 to the lower retracted or stowed position, the back 60 is simply lifted until the top surface **62*b* of the notches clears the top surface 30*a* of the catch. Once this clearance is reached, the entire back 60 can be rotated towards the seat 28 and once the lower portion of the vertical support members 62 are aligned to pass rearwardly of the catch 30, back 60 can be released and effectively lowered to the retracted or stowed position of FIG. 3. Note again that there is a stop structure that limits the downward movement of the back 60. In the case of the present design, the back structure and particularly the pad 66 is designed to engage the base frame of chair 10** to create this stop. It is appreciated that other types of stops may be employed for this same purpose.

To raise the back 60 from the retracted or stowed position of FIG. 3 to the upper operative position of FIG. 2, the back 60 is simply lifted until the top surface **62*b* of the notches clear the height of the catch 30. Next, the back is rotated away from the seat or counterclockwise as viewed in the drawings. Then the back is lowered to where the notches engage the upper and rear portions of the catch 30**.

Figure 4:
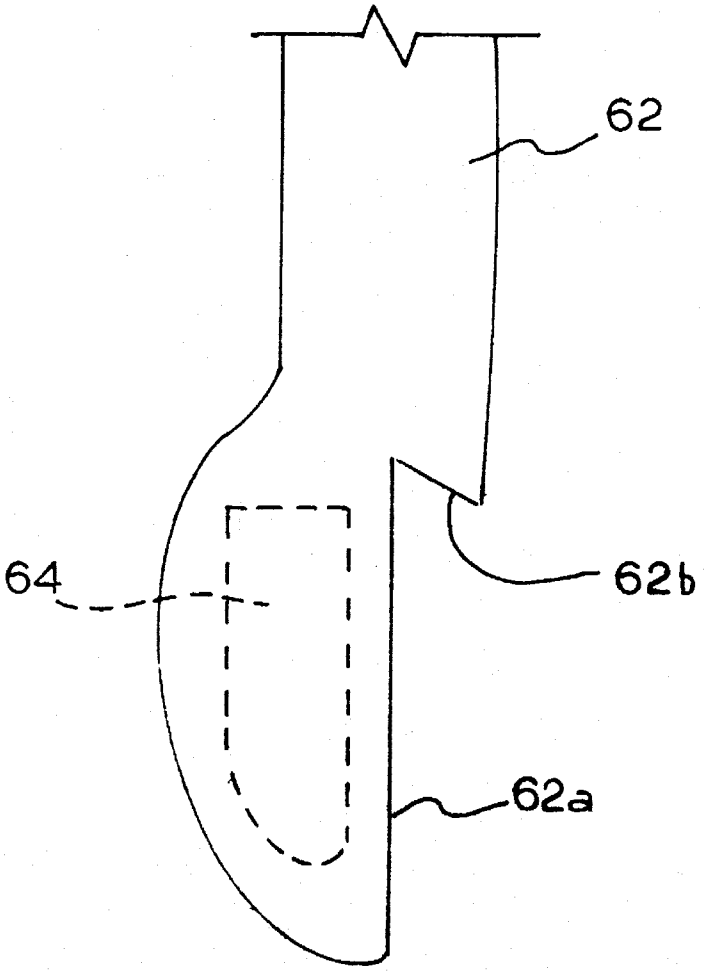
FIG. 4 is a fragmentary side view of the notch formed on the lower portion of the back.
Figure 6:
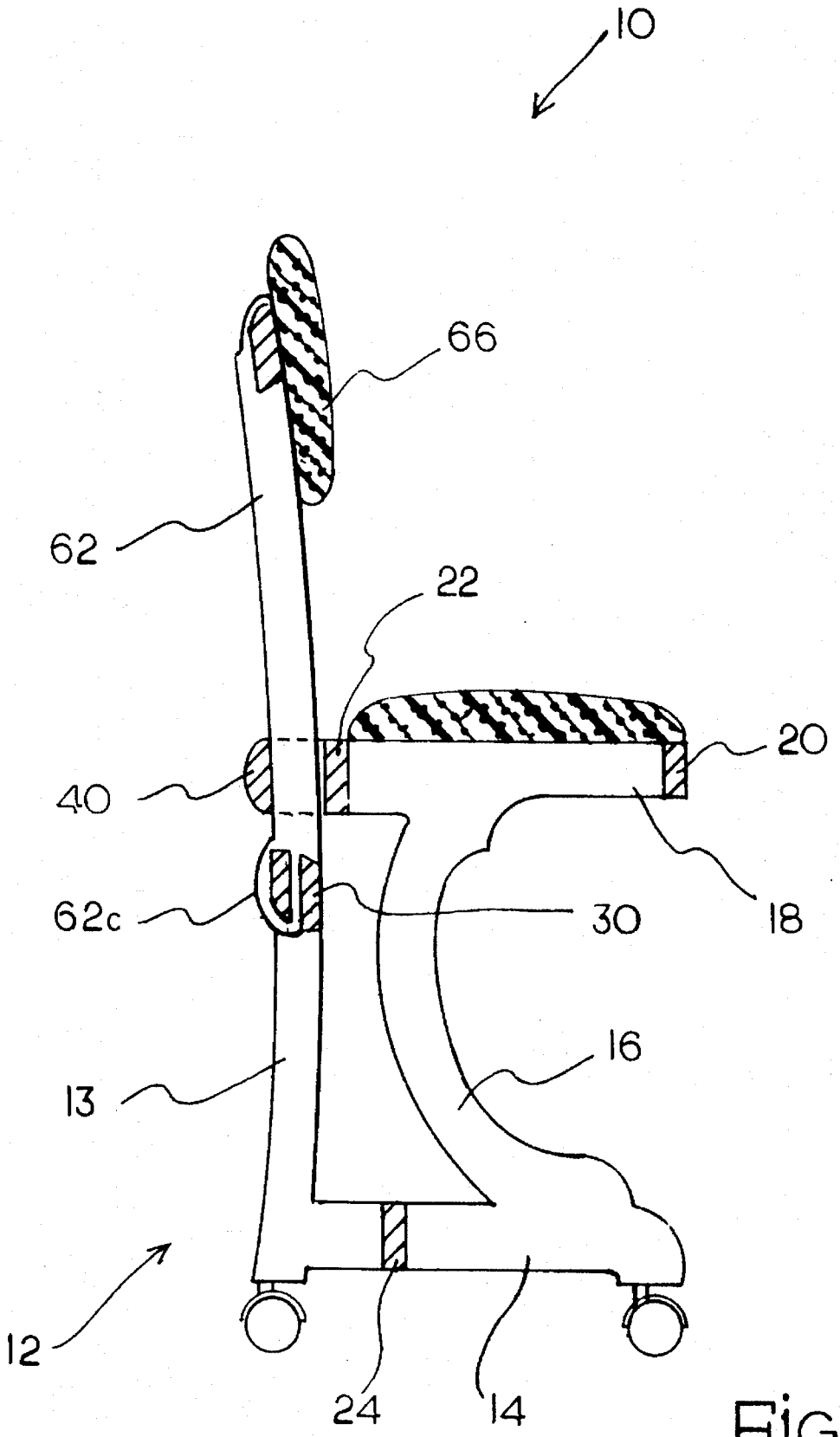
FIG. 6 is a side elevational view of another design of the chair of the present invention with the chair being shown such that portions of the base frame is cut away to better illustrate the internal structure of the chair.

In FIG. 4, there is shown another design for the chair 10 of the present invention. This design operates in the same manner as the chair disclosed in FIGS. 1–3 and described above. However, there are some differences insofar as the location of certain components of the chair. Note in the design of FIG. 4 where the catch 30 extends between the vertical members 13 of the side frame. Also, it is appreciated that the respective side frames that form the base frame 12 of the chair is of a slightly different design. In the chair disclosed in FIG. 4, the opening between the vertical members 13 and the forward structure of the base frame 12 extends upwardly to a point adjacent the upper portions of the base frame 12. But again, as noted above, the basic structure and operation of the chair 10 remains the same.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A chair having a back movable up and down between an elevated operative position and a lower retracted position, comprising:

a) a base frame including a seat;

b) a back structure extending upwardly from the base frame and including a pair of laterally spaced support members that are movable up and down within the base frame and a back pad secured to the support members for engaging the back of a person sitting in the chair;

c) each of the laterally spaced support members including lower end portions having a support notch formed therein;

d) a transverse catch rail integral with the base frame and extending across the base frame at a position below the seat and including an upper support surface for engaging the support notches and supporting the laterally spaced support members and the back structure in an upper elevated operative position;

e) a retaining rail integral with the base frame and extending transversely across the base frame at a position above and slightly rearwardly of the catch rail and wherein the laterally spaced support members of the back structure extend through and are generally confined between the retaining and catch rails and wherein in the elevated operative position the support members of the back structure rest against the retaining rail and the retaining rail prevents the back structure from rotating in the direction of the retaining rail while the support members are supported by the catch rail; and f) wherein the back support members can be moved up and down between the elevated operative position and the lower retracted position and wherein the back support members are generally confined between the retaining and catch rails in the process.

2. The chair of claim 1 wherein the downward movement of the back structure is limited by the back structure engaging the base frame and wherein the engagement of the back structure with the base frame defines a lower retracted position.

3. The chair of claim 1 wherein each of said support notches is formed on a front side of the lower portion of each of said support members and wherein the notch comprises a side surface and a top surface that angles downwardly relative to the side surface so as to form a generally open notch.

4. The chair of claim 3 wherein the upper support surface of the catch rail conforms in shape to the shape of the support notches.

5. The chair of claim 4 wherein the upper support surface of the catch rail includes a top surface that angles downwardly towards a front portion of the catch rail.

6. The chair of claim 1 wherein the portions of the laterally spaced support members of the back structure that project below the seat are confined with the base frame.

7. A chair having a back movable between an upper operative position and a lower retracted position comprising:

a base frame having a seat; a catch disposed below the seat; a retainer spaced above the catch so as to define a throughway between a catch and retainer; a back movable relative to the base frame between an upper operative position and a lower retracted position, the back including a portion that projects downwardly through the throughway between the catch and retainer and wherein that portion of the back is movable back and forth in the throughway; wherein the back includes a notch having a side and top that engages the catch when the back assumes the upper operative position and wherein the top of the notch rests on the catch when the back assumes the upper operative position and prevents the back from moving downwardly while the side of the notch in cooperation with the retainer prevents the back from rotating away from a substantially vertical position and wherein the back includes a stop structure and wherein the back can be placed in the lower retracted position by disengaging the notch from the catch and allowing the back to move downwardly through the throughway between the catch and the retainer until the stop structure engages a portion of the base frame.

8. The chair of claim 7 wherein the top of the notch is angled downwardly and forwardly and wherein the catch includes an upper surface that is angled upwardly and rearwardly so as to form a mating surface between the notch and catch.

9. The chair of claim 8 wherein the side of the notch faces toward the front of the chair and engages a rear portion of the catch when the back assumes the upper operative position and wherein the retainer is spaced rearwardly of the catch and engages a back portion of the back when the back assumes the upper operative position whereby the top of the notch supports the back and prevents the back from moving to the lower retracted position while the side of the notch in cooperation with the retainer prevents the back from rotating away from the seat with respect to the base frame.

10. The chair of claim 7 wherein the back includes a stop structure and wherein the back can be placed in the lower retracted position by disengaging the notch from the catch and allowing the back to move downwardly through the throughway between the catch and retainer until the stop structure engages a portion of the base frame.

11. A chair having a back movable up and down between an elevated operative position and a lower retracted position, comprising:

a) a base frame including a seat;

b) a back structure extending upwardly from the base frame and including a pair of laterally spaced support members that are movable up and down within the base frame and a back pad secured to the support members for engaging the back of a person sitting in the chair;

c) each of the laterally spaced support members including lower end portions having a support notch formed therein;

d) a transverse catch rail extending across the base frame at a position below the seat and including an upper support surface for engaging the support notches and supporting the laterally spaced support members and the back structure in an upper elevated operative position;

e) a retaining rail extending transversely across the base frame at a position above and slightly rearwardly of the catch rail and wherein the laterally spaced support members of the back structure extend through and are generally confined between the retaining and catch rails and wherein in the elevated operative position the support members of the back structure rest against the retaining rail and the retaining rail prevents the back structure from rotating in the direction of the retaining rail while the support members are supported by the catch rail;

f) wherein the back support members can be moved up and down between the elevated operative position and the lower retracted position and wherein the back support members are generally confined between the retaining and catch rails in the process; and g) wherein the lower end portions of the laterally spaced support members include a rearwardly projecting structure that engages a lower portion of the retaining rail in the event the support members are lifted to such a degree so as to prevent the support members from being inadvertently pulled from the base frame of the chair.

* * * * *